US007945969B1

(12) United States Patent
Krause et al.

(10) Patent No.: US 7,945,969 B1
(45) Date of Patent: May 24, 2011

(54) CORD HOLDING GARMENT

(75) Inventors: Aaron C. Krause, Cherry Hill, NJ (US); Saul Denenberg, Blue Bell, PA (US)

(73) Assignee: Innovative Accessory Products, Inc., Folcroft, PA (US)

( * ) Notice: Subject to any disclaimer, the term of this patent is extended or adjusted under 35 U.S.C. 154(b) by 0 days.

(21) Appl. No.: 12/802,842

(22) Filed: Jun. 15, 2010

(51) Int. Cl.
*A41D 13/04* (2006.01)

(52) U.S. Cl. ..... 2/51

(58) Field of Classification Search ..... 2/48, 51, 2/49.1–49.5, 52, 50, 46, 114, 102, 44, 94, 2/92, 69, 336, 338, 104; 224/575, 578, 579, 224/580, 260, 257–259, 268, 904, 247; 24/3.1, 24/3.4, 3.13; D2/861–864
See application file for complete search history.

(56) References Cited

U.S. PATENT DOCUMENTS

| | | | | | |
|---|---|---|---|---|---|
| 277,178 | A | | 5/1883 | Webb | |
| 1,027,527 | A | | 5/1912 | Davis | |
| 1,164,928 | A | | 12/1915 | Corcoran | |
| 1,451,095 | A | | 4/1923 | Greene | |
| 1,538,982 | A | | 5/1925 | Grant | |
| 1,765,009 | A | | 6/1930 | Fedorcak | |
| 2,602,575 | A | | 7/1952 | Olson | |
| 2,714,979 | A | | 8/1955 | McCarthy | |
| 2,846,686 | A | * | 8/1958 | Tames | 2/114 |
| 3,633,215 | A | | 1/1972 | Richards et al. | |
| 3,729,747 | A | | 5/1973 | Belkin | |
| 3,862,709 | A | | 1/1975 | Roshaven | |
| 3,977,584 | A | | 8/1976 | Pecoraro | |
| 4,417,146 | A | | 11/1983 | Herbert | |
| 4,622,699 | A | * | 11/1986 | Spriggs | 2/114 |
| 4,637,075 | A | | 1/1987 | Ingrisano et al. | |
| 5,265,782 | A | | 11/1993 | McNamara | |
| 5,410,758 | A | | 5/1995 | Dupont et al. | |
| 5,441,188 | A | | 8/1995 | Rosenstein | |
| 5,611,085 | A | | 3/1997 | Rasmussen | |
| 5,652,961 | A | | 8/1997 | Knight-Yurt | |
| 5,758,809 | A | | 6/1998 | Bonner | |
| 5,774,950 | A | | 7/1998 | Stout | |
| D402,788 | S | | 12/1998 | Blankenship, Jr. | |
| 5,897,519 | A | | 4/1999 | Shesol et al. | |
| 5,907,869 | A | | 6/1999 | Bohn et al. | |
| 5,960,471 | A | | 10/1999 | Burton | |
| 5,964,386 | A | | 10/1999 | Cote | |
| 5,991,925 | A | * | 11/1999 | Wu | 2/102 |
| 6,032,289 | A | | 3/2000 | Villapiano | |
| RE36,869 | E | * | 9/2000 | Ewen | 450/1 |
| 6,158,636 | A | | 12/2000 | Latiolais | |
| 6,230,329 | B1 | * | 5/2001 | Jennings | 2/114 |
| 6,286,147 | B1 | * | 9/2001 | Ingold | 2/114 |
| 6,336,578 | B1 | | 1/2002 | Maynard | |
| 6,523,227 | B2 | | 2/2003 | Goodall | |
| 6,973,673 | B2 | * | 12/2005 | Beuk | 2/114 |
| 7,048,160 | B2 | | 5/2006 | Anderson | |

(Continued)

*Primary Examiner* — Amy B Vanatta
(74) *Attorney, Agent, or Firm* — Norman E. Lehrer

(57) ABSTRACT

A garment, in the form of an apron, holds an electrical cord out of the way. The apron includes an elongated length of material having a front panel, a rear panel, and a neck portion adapted to fit about a person's neck and a plurality of releasable fasteners for securing the cord to the elongated length of material. The length of material is adapted to cover a person's torso. The releasable fasteners may be attached to the neck portion and to the elongated length of material. Each of the fasteners may include a strap adapted to hold the cord and hook and loop type fasteners.

1 Claim, 2 Drawing Sheets

U.S. PATENT DOCUMENTS

| | | | |
|---|---|---|---|
| 7,761,930 | B2 | 7/2010 | Krause et al. |
| 2003/0201287 | A1 | 10/2003 | Fisher |
| 2005/0091723 | A1 | 5/2005 | Niederhofer |
| 2007/0028342 | A1 | 2/2007 | Chan |
| 2007/0157362 | A1 | 7/2007 | Rogers |
| 2007/0277280 | A1 | 12/2007 | Kelly |
| 2009/0031471 | A1 | 2/2009 | Dague |
| 2009/0151040 | A1 | 6/2009 | Lee-Johnson et al. |

* cited by examiner

CORD HOLDING GARMENT

CROSS REFERENCE TO RELATED APPLICATIONS

This application claims the benefit of prior U.S. application Ser. No. 12/655,872, filed Jan. 8, 2010, now U.S. Pat. No. 7,761,930, which prior application claims the benefit of U.S. application Ser. No. 12/214,389, filed Jun. 18, 2008, now abandoned.

BACKGROUND OF THE INVENTION

The present invention is directed toward a garment worn by a person using a corded electrical appliance and more particularly, toward a garment that allows a person to safely work unhindered by an electrical cord while using the electrical appliance.

Often when using an electrical appliance or electrically powered tool, a power cord is associated with the appliance or tool. Although various battery operated power tools are available, corded tools are still frequently more desirable as they are normally more powerful and can operate for longer periods of time.

One concern when using such appliances or tools is, however, that the cord must be kept out of the person's way while he or she works. It is not only inconvenient to constantly have to move the cord out of one's way while working, it is also a matter of safety. That is, it is important that the cord not get in the way of the appliance being used. Also, a person must be able to see clearly and without any obstructions while using an electrical appliance. For example, a sander, a buffer, a hedge trimmer, and the like all typically involve an electrical cord that must be kept out of the way of the user. Various attempts have been made to provide an electrical cord holder that keeps the cord away from a person as he or she uses an electrical appliance.

For instance, U.S. Pat. No. 5,758,809 to Bonner discloses a cord holding harness that includes a suspender-like strap that fits over the upper torso of a person and a sleeve attached to one of the straps. The strap includes a hook for engaging the cord of the electrical appliance. This cord holder, however, does not appear to be very versatile as the device is in the form of suspenders that must be secured to a person's clothing using clips that attach to the belt or pants being worn by the person.

U.S. Pat. No. 3,862,709 to Roshaven discloses a cable holder that includes a shoulder plate having a hook to hold the cable and a plurality of straps disposed about the waist and upper portion of the wearer's body. This cable holder also must be attached to the wearer's clothing.

Also, U.S. Pat. No. 6,523,227 to Goodall discloses a shoulder mounted cord retaining clip that includes a shoulder pad portion that is positioned on a person's shoulder. Clips attached to the pad are used to hold the cord of an electrical appliance while a person is using the appliance. This device, however, does not appear to be very comfortable for the person to wear and use as the cord can still be in front of the person and potentially block his or her view of the work area or otherwise hinder the person while using the appliance.

Therefore, a need exists for an electrical cord holder that is convenient to use and will safely and securely hold a cord away from a person while he or she is using an electrical appliance.

SUMMARY OF THE INVENTION

The present invention is designed to overcome the deficiencies of the prior art discussed above. It is an object of the present invention to provide a garment that allows a person to work with an electrical appliance unhindered by an electrical cord.

It is another object of the present invention to provide a garment that may be worn by a person in order to protect his or her clothes.

It is a further object of the present invention to provide an electrical cord holder that is easy to use.

It is yet a further object of the present invention to provide a garment with a cord holder that safely and securely positions the cord of an electrical appliance away from the user of the appliance.

In accordance with the illustrative embodiments demonstrating features and advantages of the present invention, there is provided an electrical cord holding garment that includes an elongated length of material having a front panel, a rear panel, and a neck portion adapted to fit about a person's neck and a plurality of releasable securing means for securing the cord to the elongated length of material. The length of material is adapted to cover a person's torso and is the form of an apron. The releasable securing means may be attached to the neck portion and to the elongated length of material. Each of the releasable securing means may include hook and loop fasteners and a strap adapted to hold the cord.

Other objects, features, and advantages of the invention will be readily apparent from the following detailed description of a preferred embodiment thereof taken in conjunction with the drawings.

BRIEF DESCRIPTION OF THE DRAWINGS

For the purpose of illustrating the invention, there is shown in the accompanying drawings one form that is presently preferred; it being understood that the invention is not intended to be limited to the precise arrangements and instrumentalities shown.

DETAILED DESCRIPTION OF THE PREFERRED EMBODIMENT

Figure 2:
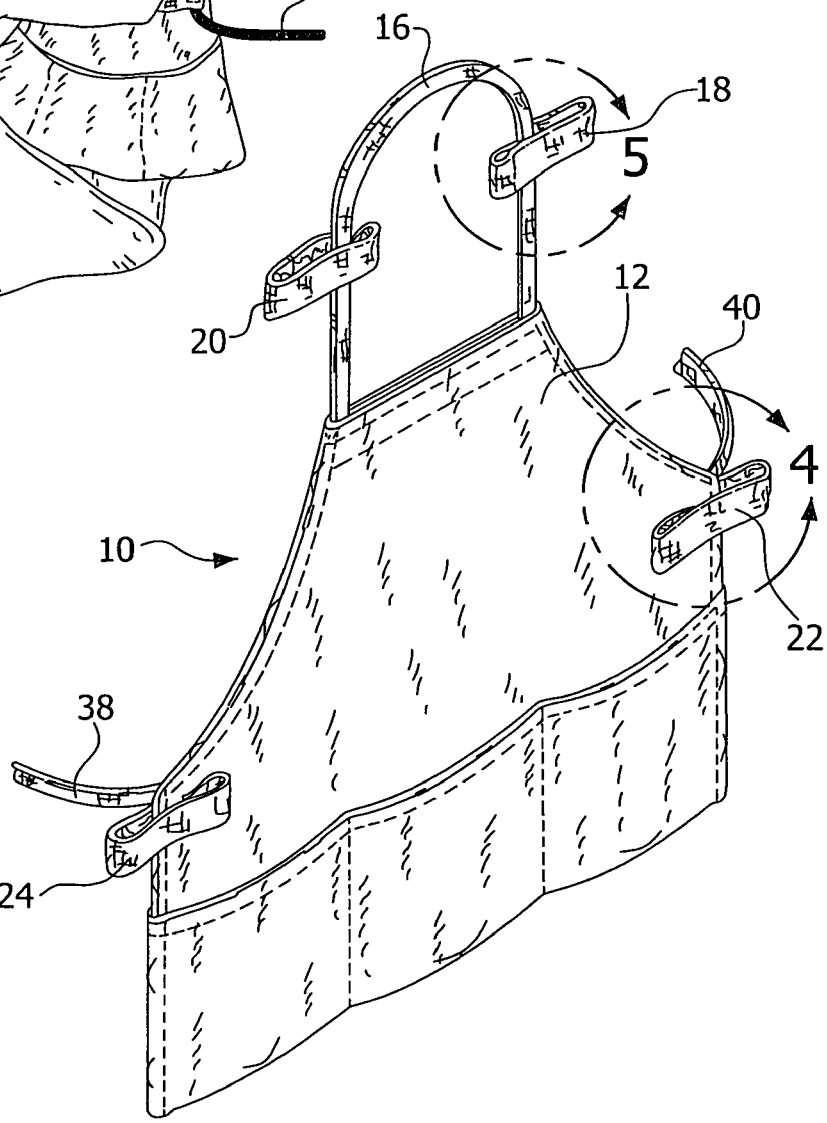
FIG. 2 is a front perspective view of the present invention.

Referring now to the drawings in detail wherein like reference numerals have been used throughout the various figures to designate like elements, there is shown in FIG. 2 an electrical cord holding garment constructed in accordance with the principles of the present invention and designated generally as 10.

Figure 1:
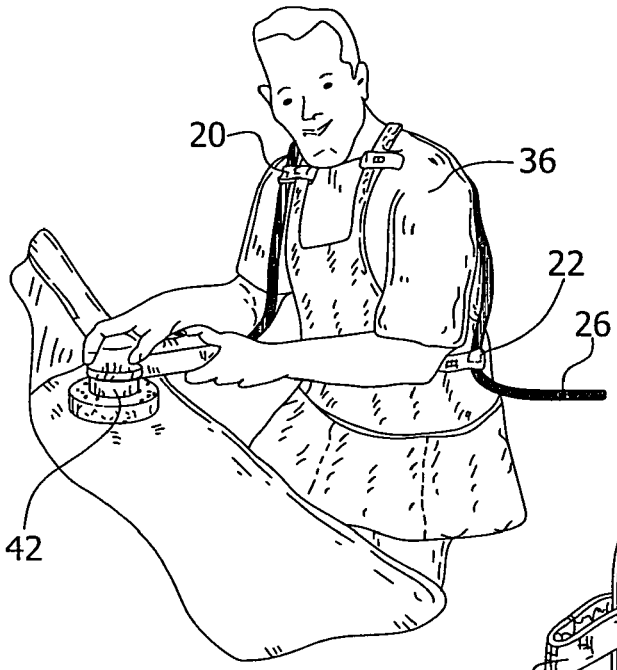
FIG. 1 illustrates the present invention being worn by a person.

In the preferred embodiment, the electrical cord holding garment of the present invention is in the form of an apron and essentially includes an elongated length of material having a front panel 12, a rear panel 14, and a neck portion 16 adapted to fit about a person's neck and a plurality of releasable securing means 18, 20, 22, and 24 for securing the cord 26 to the elongated length of material. The length of material is adapted to cover a person's torso and also can function as a conventional apron. (See FIG. 1.) The releasable securing means are preferably attached to the neck portion and to the elongated length of material at the sides thereof.

Each of the releasable securing means may include mating hook and loop fasteners, for example 28*a*, 28*b*, 30*a*, and 30*b*. Each of the releasable securing means may also include a strap 32 and 34, for example, adapted to hold the cord 26 as will be described in greater detail below. (See FIGS. 4 and 5.)

Figure 4:
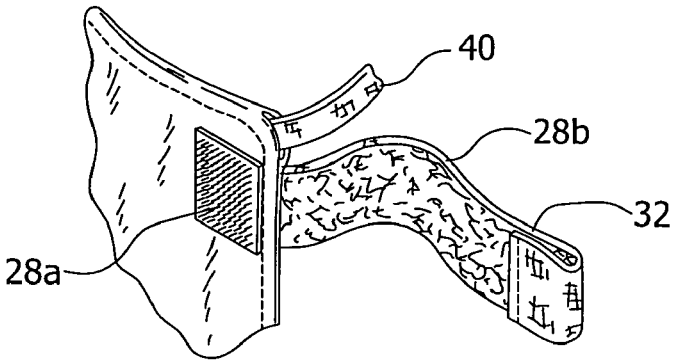
FIG. 4 is an exploded view taken through line 4 of FIG. 2.
Figure 5:
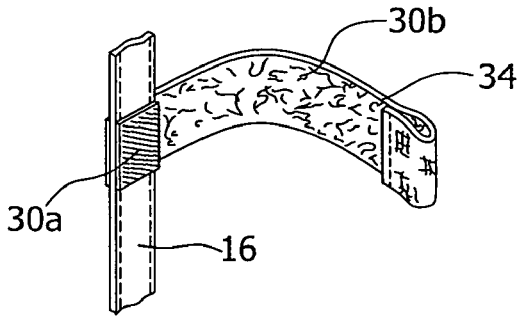
FIG. 5 is an exploded view taken through line 5 of FIG. 2.
Figure 3:
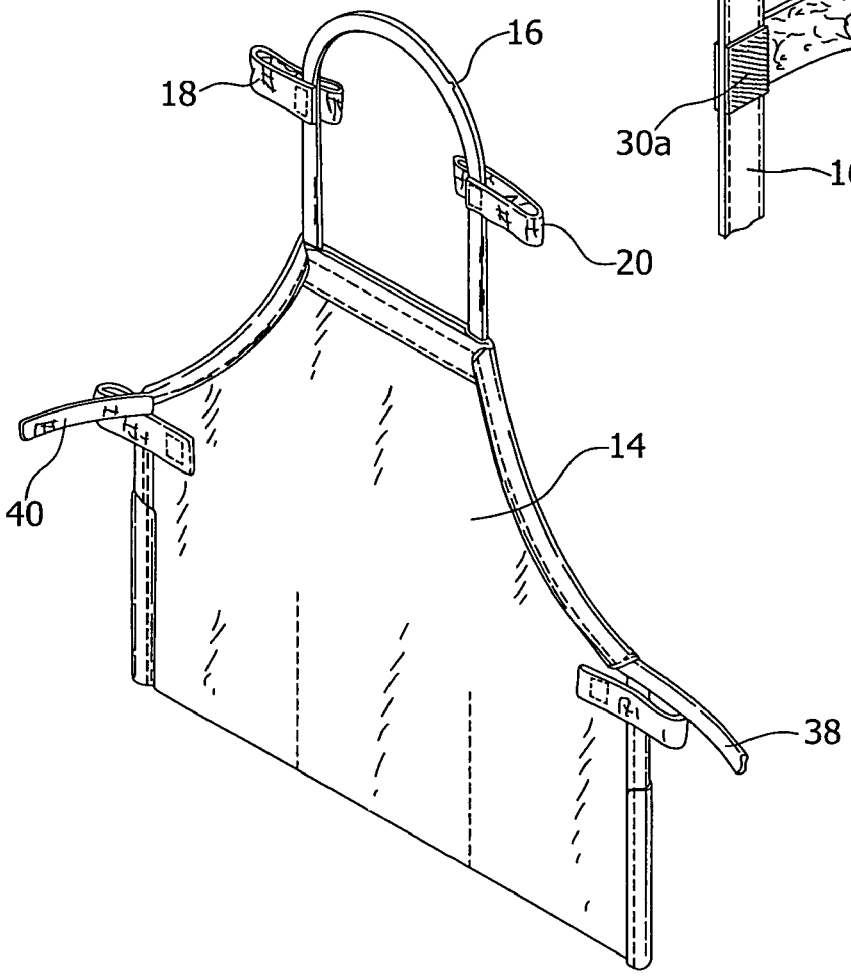
FIG. 3 is a rear perspective view of the present invention.

In order to use the garment 10 of the present invention, a person 36 slides the neck portion 16 of the garment around his or her neck and then, in a conventional manner, ties the garment about the waist using straps 38 and 40. (See FIG. 3.) The securing means may be released and placed into an open position as shown in FIGS. 4 and 5. The cord 26 of the appliance 42 may now be threaded through as many of the securing means 18, 20, 22, and 24 as desired. For example, the cord 26 may be threaded through one of the securing means 22 located adjacent the person's waist on his left side, across the person's back, and through the securing means 20 located on the neck portion 16 of the garment on the person's right shoulder and on the opposite side of the securing means 22. (See FIG. 1.) The securing means are then closed or refastened. This arrangement of the cord 26 relative to the garment 10 is, of course, by way of example only. In some situations, it may be desirable to connect the cord 26 to others of the securing means.

The garment may be used in a variety of ways. For example, the cord may be secured to only one side of the garment. (See FIG. 1.) Alternatively, all of the securing means may be used to hold the cord away from the person as he or she is working.

The present invention may be embodied in other specific forms without departing from the spirit or essential attributes thereof and accordingly, reference should be made to the appended claims rather than to the foregoing specification as indicating the scope of the invention.

We claim:

1. A method for safely supporting the electrical power cord of an electrical power tool being held by a workman's hands for use in front of the workman comprising:

providing the workman with a cord holding garment in the form of an apron and wherein said garment is comprised of an elongated length of material with a right side, a left side, a front panel and a rear panel; said garment also having a neck portion having a right side and a left side which extend upwardly from said elongated length of material and fit about a person's neck; said garment further having at least one strap extending outwardly from one of said sides of said material and being adapted to maintain said apron about the person's torso and a plurality of pockets carried by said length of material on the front panel thereof; said garment further having at least two releasable securing means for securing the cord to said apron, a first of said releasable securing means being attached to said right side of said neck portion and the second of said releasable securing means being attached to said left side of said neck portion;

wrapping said strap around the workman's back to maintain said apron about the torso of said workman;

passing said cord from behind the workman's back to said power tool located in front of said workman, said cord being passed over the workman's shoulder and securing said cord to one of said first or second securing means.

* * * * *